US008657220B2

(12) United States Patent
Van der Zanden

(10) Patent No.: US 8,657,220 B2
(45) Date of Patent: Feb. 25, 2014

(54) ROTOR WITH CLOSED CENTRE SPACE AND COVER MEMBER

(76) Inventor: Johannes P. A. J. Van der Zanden, Klimmen (NL)

( * ) Notice: Subject to any disclaimer, the term of this patent is extended or adjusted under 35 U.S.C. 154(b) by 339 days.

(21) Appl. No.: 13/002,879

(22) PCT Filed: Jul. 6, 2009

(86) PCT No.: PCT/NL2009/000143

§ 371 (c)(1),
(2), (4) Date: Mar. 28, 2011

(87) PCT Pub. No.: WO2010/005287

PCT Pub. Date: Jan. 14, 2010

(65) Prior Publication Data

US 2011/0168824 A1 Jul. 14, 2011

(30) Foreign Application Priority Data

Jul. 8, 2008 (NL) ..... 1035674

(51) Int. Cl.
*B02C 19/00* (2006.01)

(52) U.S. Cl.
USPC ..... 241/101.2; 241/275

(58) Field of Classification Search
USPC ..... 241/5, 101.2, 275, 278.1, 283
See application file for complete search history.

(56) References Cited

U.S. PATENT DOCUMENTS 6,149,086 A 11/2000 Young et al.

FOREIGN PATENT DOCUMENTS

| | | | |
|---|---|---|---|
| CA | 2412314 | C | 2/2002 |
| WO | 96/32197 | A1 | 10/1996 |
| WO | 98/16319 | A1 | 4/1998 |
| WO | 01/45846 | A1 | 6/2001 |
| WO | 02/09878 | A1 | 2/2002 |

OTHER PUBLICATIONS

PCT International Search Report for International Application No. PCT/NL2009/000143, mailed Oct. 26, 2009.

*Primary Examiner* — Dana Ross
*Assistant Examiner* — Homer Boyer
(74) *Attorney, Agent, or Firm* — Holland & Hart LLP

(57) ABSTRACT

The invention relates to a rotor (139) for the acceleration of material, in particular a stream of granular or particulate material, with the aid of centrifugal force, with, in particular, the aim of causing the accelerated grains or particles to collide with an impact member at such a velocity that the particles are crushed. The invention provides ways to hinder that particles are pulled from the center space though vortex pulling. The sliding member (143) is provided with a closed space that provides the rotor with a closed center space. When the sliding member (143) are positioned some distance away from the metering member (141), a cover member (134) is positioned above the rotor (139) between the metering member and the sliding member. This enables to design the sliding members shorter and hence cheaper. It enables to place more sliding members on the rotor and hence increase continuous operation time accordingly.

20 Claims, 9 Drawing Sheets figure (table) 11

| start radius r1 | end radius r2 | collect velocity Vc | length sliding face - l | take-off velocity Va | take-off angle α | speed |
|---|---|---|---|---|---|---|
| 150 mm | 600 mm | ~13 m/s | 450 mm | ~70 m/s | ~43° | 800 rpm |
| 250 mm | 600 mm | ~21 m/s | 350 mm | ~69 m/s | ~41° | 800 rpm |
| 350 mm | 600 mm | ~30 m/s | 250 mm | ~66 m/s | ~39° | 800 rpm |
| 375 mm | 600 mm | ~32 m/s | 225 mm | ~64 m/s | ~37° | 800 rpm |
| 450 mm | 600 mm | ~38 m/s | 150 mm | ~62 m/s | ~33° | 800 rpm |

ROTOR WITH CLOSED CENTRE SPACE AND COVER MEMBER

FIELD OF THE INVENTION

The invention relates to the field of the acceleration of material, in particular a stream of granular or particulate material, with the aid of centrifugal force, with, in particular, the aim of causing the accelerated grains or particles to collide with an impact member at such a velocity that they are crushed, but other possible applications are not excluded.

BACKGROUND TO THE INVENTION

A stream of particle material can be accelerated on an open rotor with the aid of centrifugal force. With this technique the material is fed into the central part of the rotor that rotates rapidly about a vertical axis of rotation, which material is then collected by one or more sliding members, which are positioned on the rotor, hence the name open rotor, which is known from U.S. Pat. No. 6,149,086. The sliding member is provided with a sliding face that stretches into the direction of the outer edge of the rotor between an inner face that is directed towards the axis of rotation and stretches in vertical direction between a bottom edge and an top edge, and an outside face that is directed towards the housing that surrounds the rotor. Particles are collected at the inner face by the first part of the sliding face, then accelerated along the slicing face under influence of centrifugal force and then throw outwards to collide with a stationary impact member that is positioned around the rotor, when the material is crushed. Instead of allowing the material to impinge directly on a stationary impact member, it is also possible to allow the material to impinge first with a co-rotating impact member that is associated with the sliding member, the material being simultaneously loaded and accelerated during the co-rotating impact, with which velocity the material is then thrown from the rotor for a second impact when it strikes the stationary impact member. Such rotor is known from PCT/NL97/00565, which was drawn up in the name of the applicant.

The material is normally fed onto the centre of the open rotor with the aid of an metering member that is provided with a circular metering opening, for example an metering pipe. With an open rotor the outer edge of the metering opening has to be positioned closely to the top edge of the inner face of the sliding members, because the feed material has a strong tendency to escape when there is space between the outer edge of the metering opening and the top edge of the inner face of the rotating sliding members, and this can strongly disturb the accelerating process. The reason for this is that the rotating flow creates a rather concave vortex above the rotor—essentially in a way tea rotates in a cup—and this vortex generates a rather strong upward flow that exerts a pull on the particles in the centre space of the rotor; that is, until they are collected by the sliding members. It can however not be avoided that the metering opening wears off and this requires that the position of the metering member has to be adjusted close to the top edges of the inner faces each time when the sliding members are exchanged because of wear. Such wear can be irregular in which case correct positioning above the sliding members is no longer possible and early exchange of the metering member is required.

Escape of particles because of vortex pulling can be hindered in that the inner face of the sliding member can be angled outwards, that is, with the bottom edge of inner face positioned at a greater radial distance from the axis of rotation than the top edge—such sliding member is known from WO0145846, which was drawn up in the name of the applicant. When the angled inner face rotates it describes essentially a downward widening truncated cone that improves the collection of the material in that it hinders upwards movement of particles. The known sliding member has, however, a problem in that particles and hence wear concentrate at the bottom edge of the inner face and from there along the bottom edge of the sliding face causing irregular wear patterns and non-effective use if wear material while total capacity is reduced. Furthermore, intense wear develops along the rotor face in front of the sliding members where the material is collected.

Another disadvantage with the known sliding members is that the sliding face has to stretch along a rather long distance, that is, from as close as possible to the metering opening towards the outer edge of the rotor. This requires much wear material and limits the number of sliding members that can be positioned around the centre part of the rotor because ample space is required between the inner faces of the sliding members to allow unhindered transport of the material to the respective sliding faces.

Particles that are metered into the centre space of the rotor do not feel the fast rotating face, in a way a magician pulls a table cloth fast from underneath the table wear that remains in place. This means that the particles move outwards in essentially radial direction, that is, seen from a stationary point of view. However, seen from a viewpoint rotating with the sliding member, the particles move outwards along a spiral path as is described in more detail in PCT/NL97/00565, which was drawn up in the name of the applicant. It is this spiral movement that applies, when the particles are collected at the collecting face of the sliding member, to be further accelerated along the sliding face. This means that the particles have to change direction when they are collected by the sliding face. So, the collection process involves essentially an impact of the particle with the sliding member during which impact the particles suddenly change direction and are instantly accelerated to take the velocity of the collecting face. With radial directed sliding members the change of direction is normally between 60° and 80°. The acceleration depends on the speed of the collecting face and increases with radius and rotational velocity.

Another important development with sliding members involve cavities and pockets along the sliding face as well as ceramic inserts to prolong operation time. Such sliding member is known from WO 02/09878.

Vortex pull, impact and change of direction disturb the collection process and cause heavy wear along the rotor face and along the metering opening. It is for this reason that the sliding members have to be positioned as close as possible to the axis of rotation with the top edge of the inner face as close as possible to the outer edge of the metering opening—this limits but does not avoid these problems and requires constant adjustment of the metering opening, sliding members with long sliding faces and hence much wear material and this limits the number of particles that can be placed on the rotor.

SUMMARY OF THE INVENTION

The aim of the invention is, therefore, to provide an open rotor as described above that does not have these disadvantages, or at least displays these to a lesser extent. The principle aim of the invention is to limit disturbance by vortex pull and that the particles are collected by the sliding face in a more regular way. A further aim of the invention is to limit concentration of wear along the bottom edge of the inner face the sliding face of the sliding member and along the rotor face in front of the sliding members and along the outer edge of the metering opening.

According the invention this is achieved by providing the sliding member, that is provided with a sliding face that stretches into the direction of the outer edge of the rotor between an inner face that is directed towards the axis of rotation where the metered material is collected for accelerating along the sliding face by centrifugal force and an outside face that is directed towards the surrounding housing from where the accelerated material is thrown from the sliding face, which inner face stretches in vertical direction between a bottom edge and a top edge, with an inner face that is positioned essentially behind the straight plane and includes the bottom edge and the top edge, such that part of the inner face is positioned at a greater distance from the axis of rotation than the straight plane and a closed space is created between the straight plane and the inner face. The invention is further described in the description and the claims, to which reference is made.

A sliding member with a closed inner space does not only hinder escape of particles from the centre part but also limits concentration of wear along the sliding face and along the rotor face wear—it also allows for a gap distance between the outer edge of the metering opening and the top edge of the inner face of the sliding member, which means that sliding members can be placed at a larger distance form the metering opening. Such sliding members are shorter and hence more sliding members can be positioned on the rotor without affecting the width of the transport space between the inner faces—actually a closed inner space increases the transport space. It is important to note that this does influence centrifugal acceleration to a limited degree only, that is the take-off velocity that is obtained at a certain end radius and at a certain speed of rotation—as will be explained later. Actually when the length of the sliding face is reduced by some 50%, the rotor can carry about double the amount of sliding members. This doubles the operating time before the sliding members have to be exchanged because of wear while about the same amount of wear material is utilized. But also the possible addition of only one sliding member can already result in significant savings.

The gap distance might however still cause disturbance because of vortex pulling and to hinder this the invention allows for the housing to be provided with an essentially circular cover member that is positioned stationary essentially central above the rotor and is carried by at least one stationary part of the housing such that the centre point of the cover member coincides essentially with the axis of rotation and has a radius at least equal or greater than the radial distance from the axis of rotation to the inner side of the sliding member and is in the middle provided with an essentially circular central opening of which the centre point essentially coincides with the axis of rotation and has a radius at least equal or greater than radial distance from the axis of rotation to the outer edge of the metering opening.

To this end the invention provides two possibilities to hinder escape of particles from the centre space by vortex pulling—a closed inner space along the inner side of the sliding member and a cover member above the rotor that covers the gap distance between the metering member and the sliding member—these can and often have to be applied together to be effective.

The invention provides the possibility for at least part of the face of the cover member that is directed towards the rotor to have an essentially flat surface that stretches along a horizontal plane and for at least the central part of the face of the cover member that is directed towards the rotor to have a downwards widening truncated conical shape. A possible configuration is for the cover member to have a conical shape with a flat plate around the lower edge. A flat surface along the top of the cover member has the problem that material builds up on the surface and provisions have to taken to prevent this, as will be discussed later. With the conical shape it has to avoided that a vortex develops within the cone, for which the invention provides the possibility to avoided such flow by providing the cone with radial partition walls. Another possible configuration is a cover member of circular cylindrical shape that stretches essentially in vertical direction upwards from the top edge of the inner face of the sliding member.

The invention provides the possibility for the cover member to be carried by the metering member, for example a metering pipe, or to be carried by the lid or the housing. Actually the cover member can be provided with a metering member, or part of it. The lid can consists out of an inner lid section surrounded by an outer lid section, which can be separately lifted and the cover member can be carried by one of these parts. Connected with the inner lid section or with a one part lid construction the cover member has to be lifted with the lid—the cover member is then essentially part of the metering member and can be applied as such. When carried by the outer lid section or the crushing house, the cover member stays in place when the inner lid is opened but can still be part of (part of) the metering member.

The invention provides the possibility for the metering opening to be positioned at a location closer to the rotor or further away from the rotor than the inner edge of the cover member with the outer edge of the metering opening to have a diameter that is equal or larger than the outer diameter of the metering opening. When a re-circulation opening is created between the metering member and the outer edge of the metering member recirculation of air is obtained from the space surrounding the rotor towards the space above the rotor, that is underneath the cover member which for this purpose is preferred to have a conical shape. This can limit the amount of air and dust that is transported with the broken product when it is discharged.

The invention provides the possibility for the inner edge of the cover member to consist out of at least one separate part that is exchangeable in case of wear and in a similar way for the outer edge of the cover member to consist out of at least one separate part that is exchangeable in case of wear, such that not the complete cover member has to be exchanged.

The invention provides for the possibility that the accelerating unit consists out of a sliding member and an associated co-rotating impact member, where in case the rotor is provided with a cover member, the outer edge of the cover member stretches at least to the co-rotating impact member.

The invention provides also the possibility for the sliding member to be symmetrically shaped to a radial plane from the axis of rotation, which allows for two-way operation of the rotor and more effective utilization of the wear material.

It is clear that with the sliding members according to the invention the technique of providing the sliding member along the sliding face with pockets and cavities as well as ceramic inserts can be applied.

BRIEF DESCRIPTION OF THE DRAWINGS

For better understanding, the aims, characteristics and advantages of the device of the invention which have been discussed, and other aims, characteristics and advantages of the device of the invention, are explained in the following detailed description of the device of the invention in relation to accompanying diagrammatic drawings.

Figure 10:
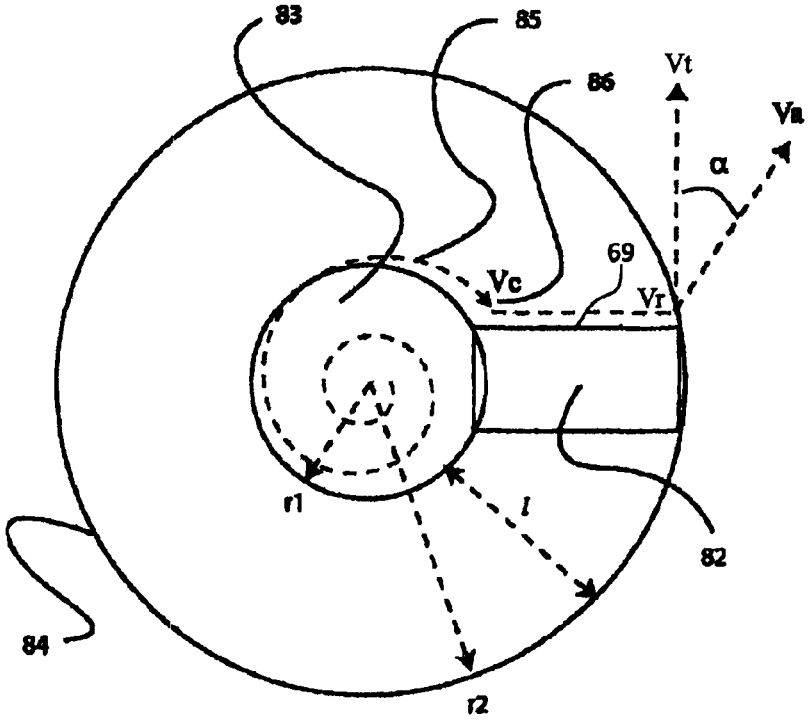
FIG. 10 shows, diagrammatically, the movement of the particles on the rotor.
Figure 12:
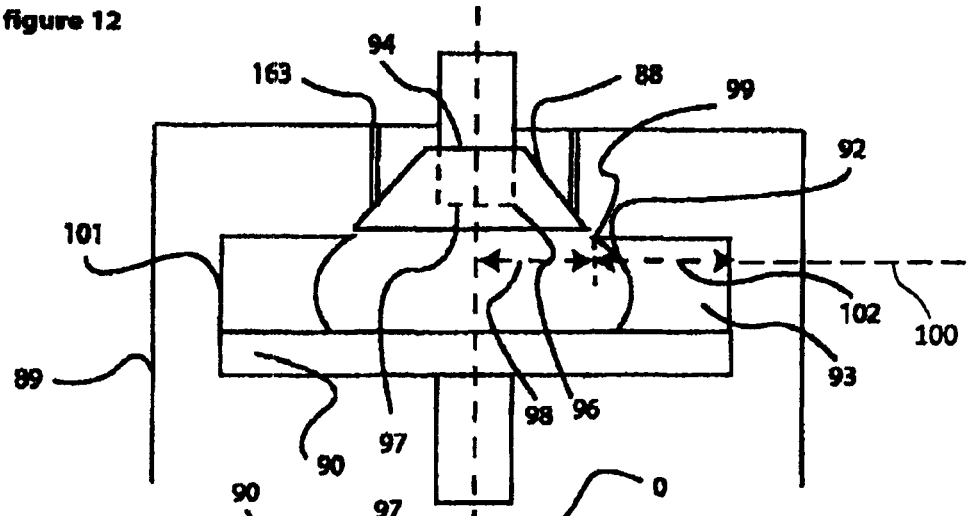
Figure 13:
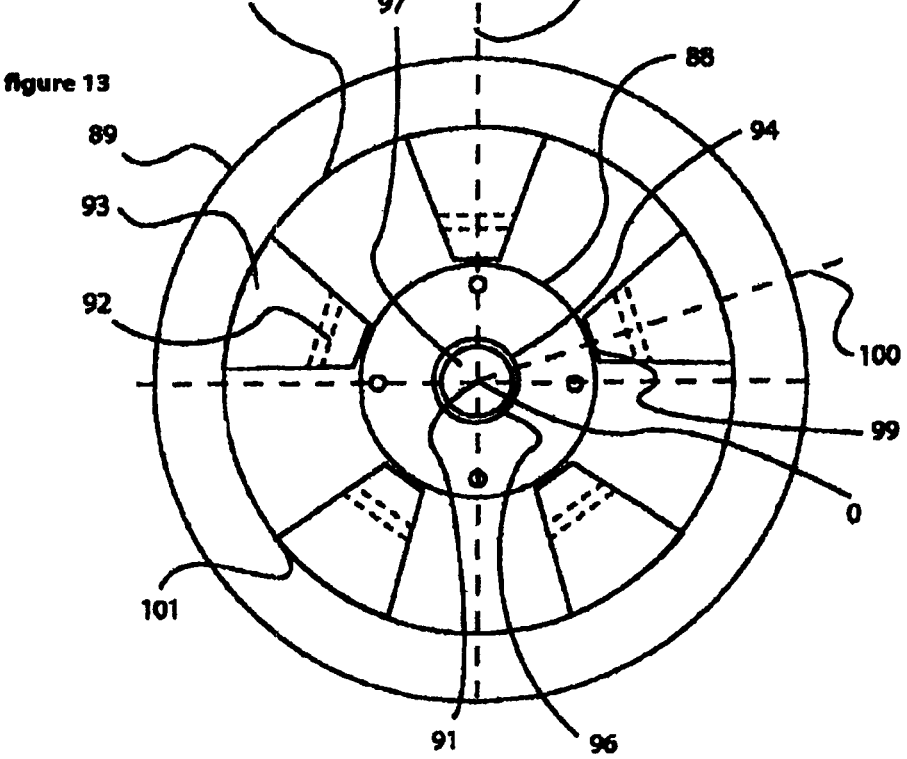
Figure 14:
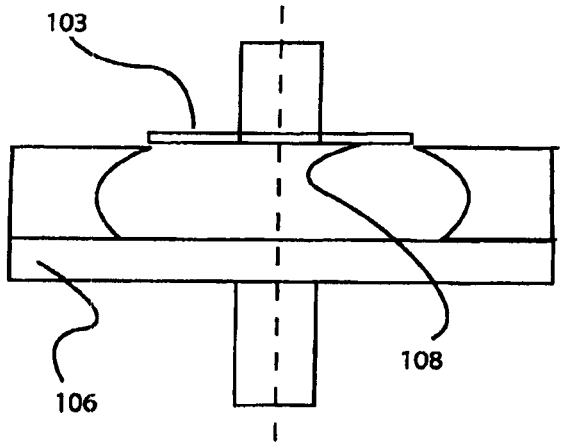
Figure 15:
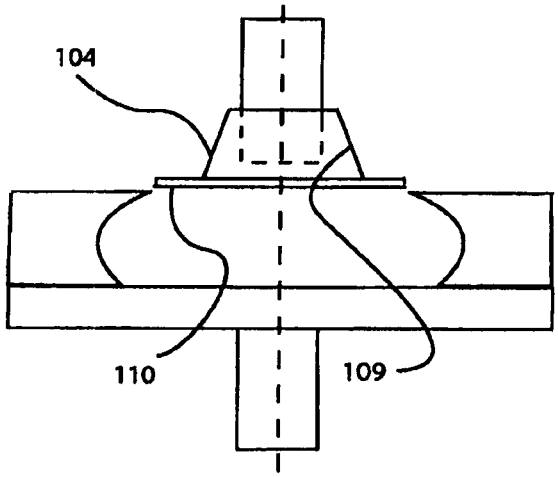
Figure 16:
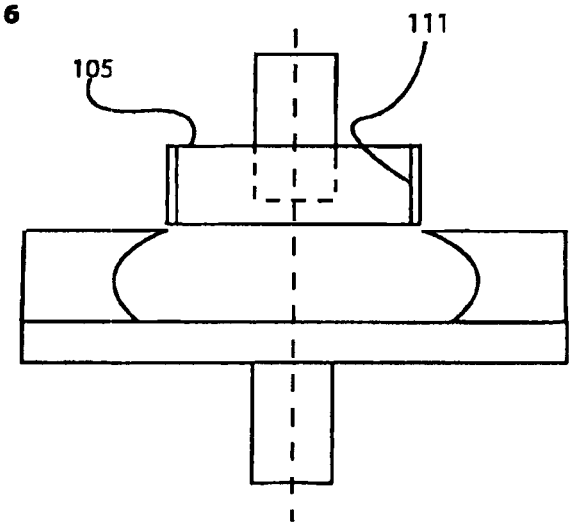
Figure 17:
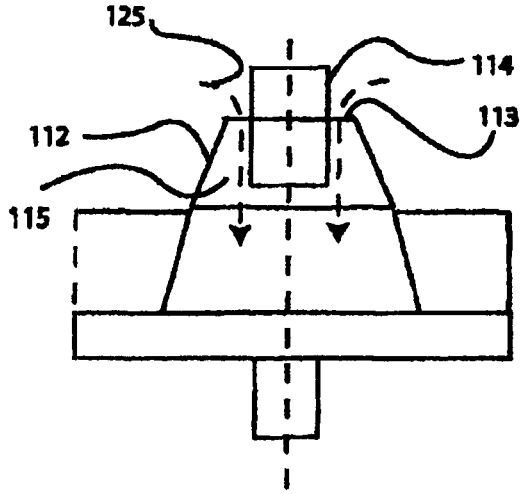
Figure 18:
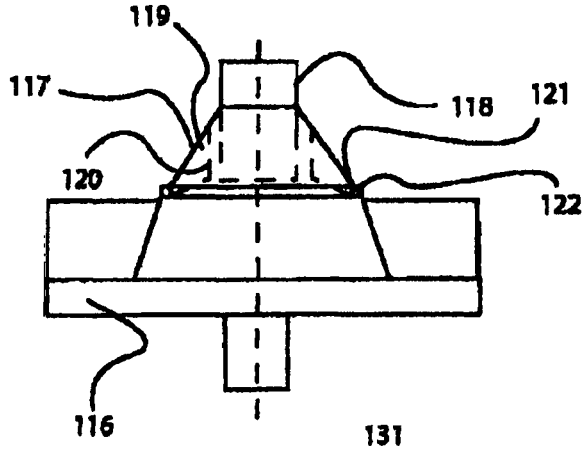
Figure 19:
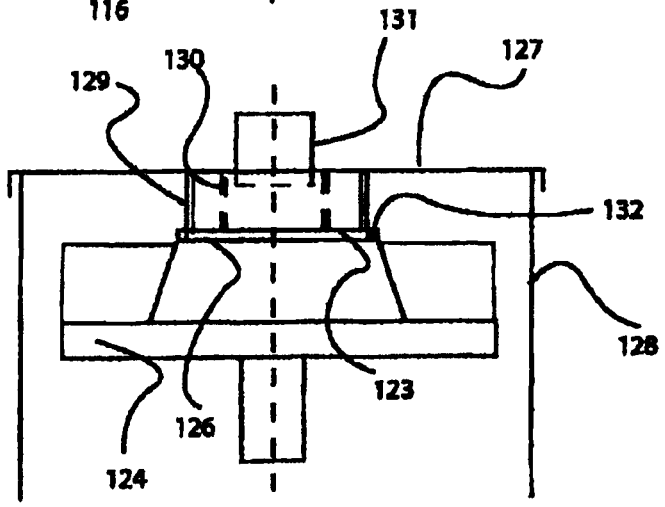
Figure 20:
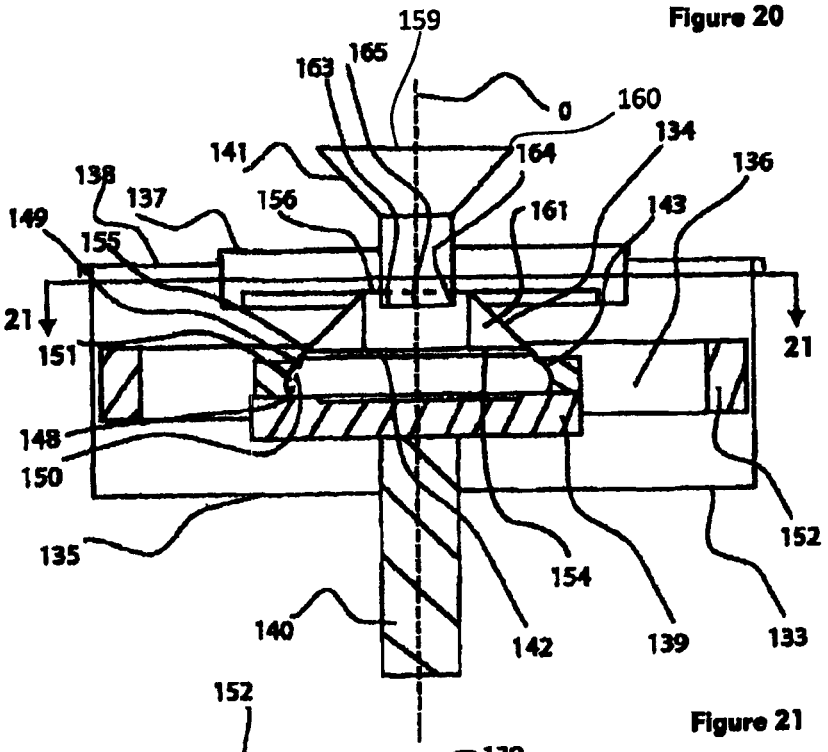
Figure 21:
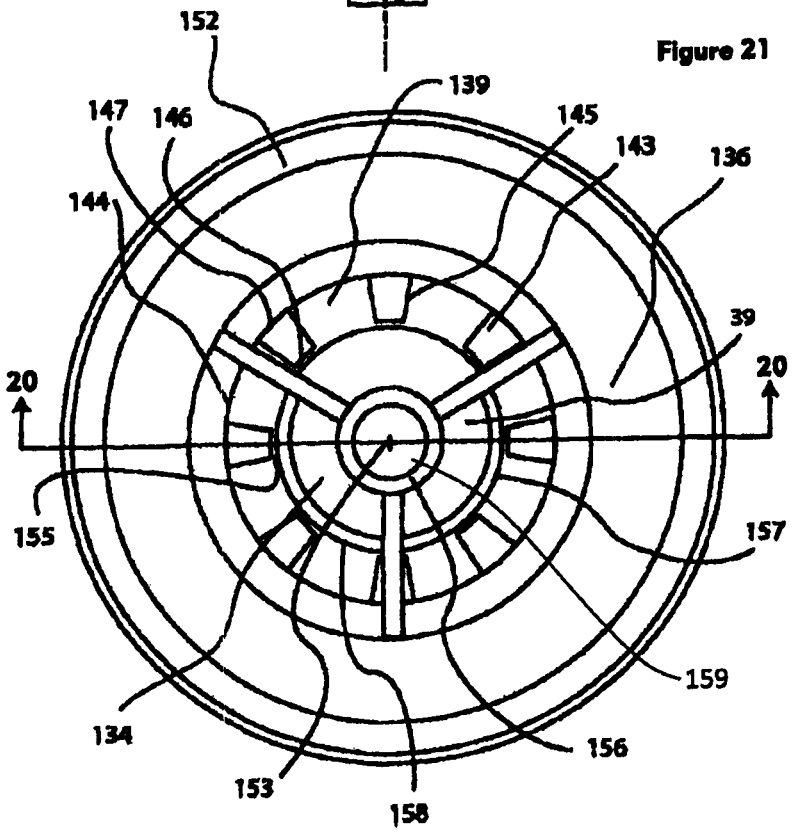

FIG. (table) 11 shows the calculated values for take-off velocity and take-off angle for constant end diameter and constant rotational velocity (rpm), but with longer start diameter as indicated in FIG. 10;

FIG. 12 shows, diagrammatically, a housing with a first basic embodiment of the cover member according the invention, FIG. 13 shows, diagrammatically, a top view of FIG. 12, FIG. 14 shows, diagrammatically, a second basic embodiment of the cover member according the invention;

FIG. 15 shows, diagrammatically, a third basic embodiment of the cover member according the invention;

FIG. 16 shows, diagrammatically, a fourth basic embodiment of the cover member according the invention;

FIG. 17 shows, diagrammatically, a fifth basic embodiment of the cover member according the invention;

FIG. 18 shows, diagrammatically, a sixth basic embodiment of the cover member according the invention;

FIG. 19 shows, diagrammatically, a seventh basic embodiment of the cover member according the invention;

FIG. 20 shows, diagrammatically, a side view B-B from FIG. 21 of housing according the invention provided with a conical cover.

FIG. 21 show, diagrammatically, a top view A-A from FIG. 20.

DETAILED DESCRIPTION

A detailed reference to the preferred embodiments of the invention is given below. Examples thereof are shown in the appended drawings. Although the invention will be described together with the preferred embodiments, it must be clear that the embodiments described are not intended to restrict the invention to those specific embodiments. On the contrary, the intention of the invention is to comprise alternatives, modifications and equivalents, which fit within the nature and scope of the invention as defined by appended claims.

Figure 1:
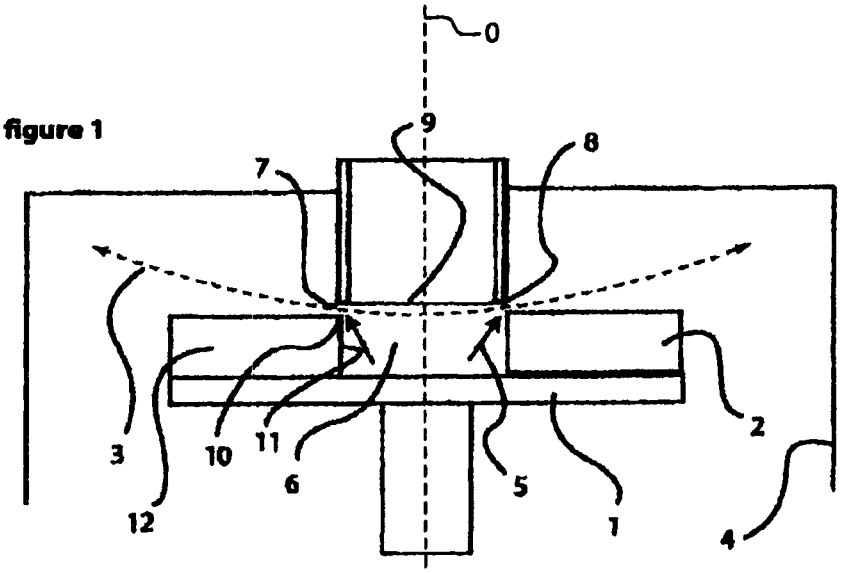
FIG. 1 shows, diagrammatically, a side view of an open rotor with sliding members where a vortex that is created above the rotor.
Figure 2:
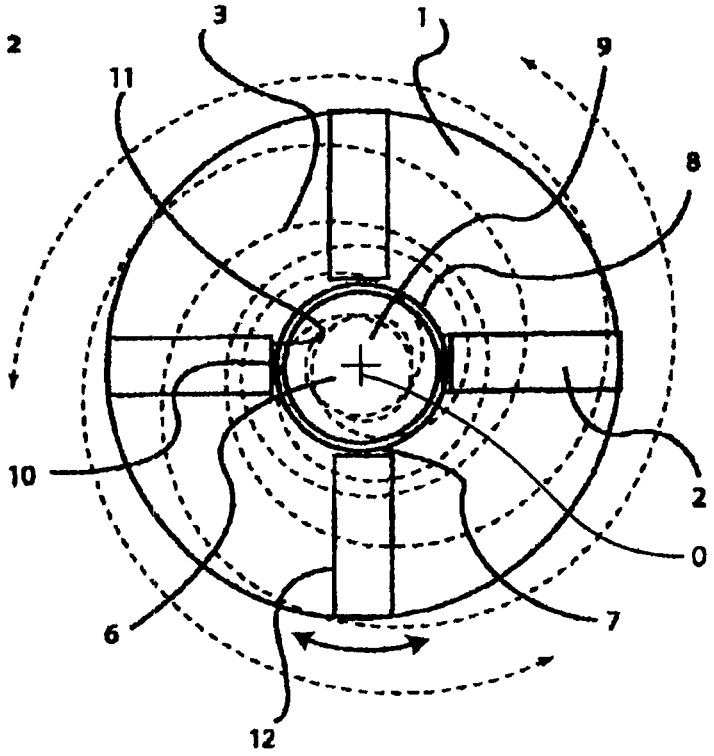
FIG. 2 shows, diagrammatically, a top view of the open rotor with vortex from FIG. 1.

FIGS. 1 and 2 show, diagrammatically, an open rotor (1) with sliding members (2) where a vortex (3) that is created above the rotating rotor (1) in a closed housing (4). This vortex (3) creates a vortex pull (5) that pulls particles from the centre space (6) of the rotor (1) through the gap distance (7) between the outer edge (8) of the metering opening (9) and the top edge (10) of the inner face (11) of the sliding member (2) that faces the axis of rotation (0). This gap distance (7) must therefore be as small as possible and that requires that the outer edge (8) of the metering opening (9) is to be positioned as closely as possible to the top edge (10) of the inner face (11), but even then particles can and do escape from the centre space (6)—in particular when the particles come in contact with the vertical inner face (11) of the sliding members (2) that are normally constructed in this way. The problem is that a vertically positioned inner face (11) does lock the particles under influence of centrifugal force but in an essentially stationary way in that the centrifugal force can exert no further forces as is the case when the face is directed outwards as is the case with the sliding face (12). This means that such stationary locked particles can move upward under influence of vortex pulling and escape the centre space (6). Escape can be hindered with a more close centre space (6).

Figure 3:
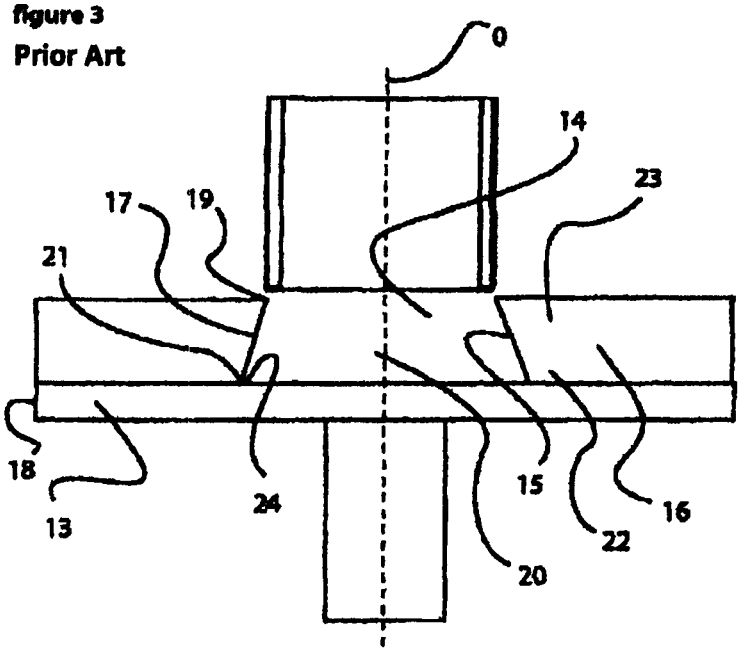
figure 3 Prior Art
FIG. 3 shows, diagrammatically, a side view from a rotor of known art where the inner side of sliding face is angled in outside direction.

FIG. 3 shows, diagrammatically, a side view from a rotor (13) of known art with a more closed centre space (14) where the inner face (15) of sliding member (16) is flat but angled along a straight line (17) (or plane) downwards in a direction towards the outer boarder (18) of the rotor (13) producing a closed centre space (14)—such that the bottom edge (21) of the inner face (15) is positioned at a greater radial distance from the axis of rotation (0) than the top edge (19) of the inner face (15). When the angled inner face (15) rotates at high velocity it describes essentially a downward widening truncated cone (20) that provides closed centre space (14) that improves the collection of the material in that it hinders upwards movement of particles along the inner face (15). The known sliding member (16) has, however, a problem in that particles concentrates along the bottom edge (21) of the inner face (15) and from there along the bottom edge (22) of the sliding face (23) which limits the capacity and causes irregular wear patterns and non-effective use if wear material. Furthermore, intense wear develops along the rotor face (24) in front of the inner face (15) and in front of the sliding face (23) where the material is collected.

Figure 4:
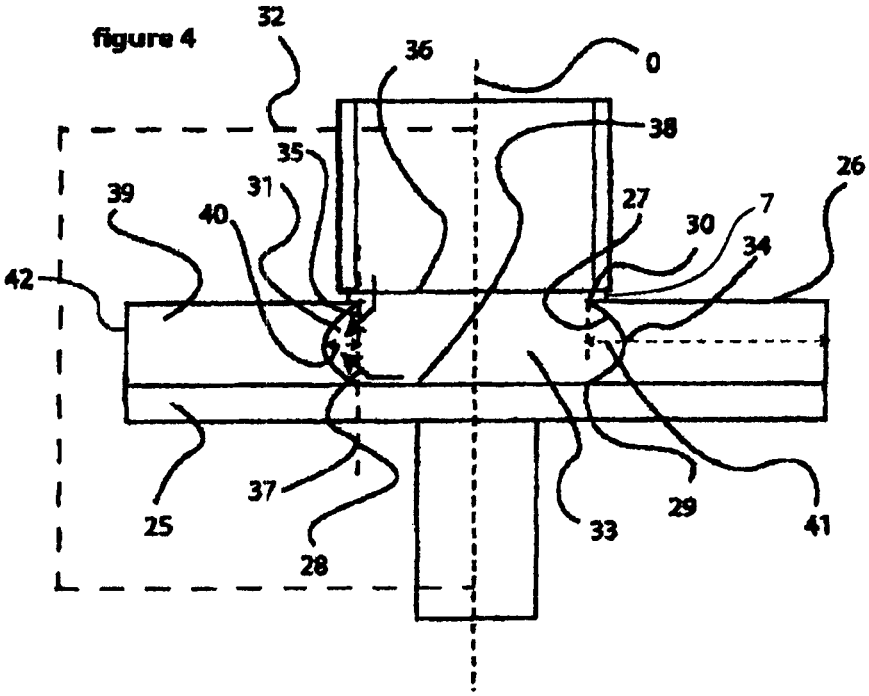
FIG. 4 shows, diagrammatically, a side view from a rotor according the invention provided with a first embodiment of the sliding member according the invention.

FIG. 4 shows, diagrammatically, a side view from a rotor (25) according the invention provided with a first embodiment of the sliding member (26) according the invention where the inner face (27) is positioned essentially behind the straight plane (28) or line with on it the bottom edge (29) and the top edge (30), which means that part of the inner face (27) is positioned at a greater radial distance from the axis of rotation (0) than the straight plane (28) and a closed inner space (31) is created between the straight plane (28) and the inner face (27). The bottom edge is here positioned at a radial distance from the axis of rotation about equal than the top edge, but it is preferred that the bottom edge is positioned at a greater radial distance than the top edge.

The here concave inner face (27) produces a bowl shaped closed centre space (33) that pulls the particle material to the centre (34) of the inner face (27) when the sliding member (26) rotates at high velocity; that is, downwards (35) from the metering opening (36) and upwards (37) from the metering face (38) of the centre space (33). This way the particle material is distributed in more regular way along the sliding face (39)—a closed centre space (33) is created that hinders escape of particle material and concentration of particles along the bottom edge (29) is avoided.

The minimum inner space distance (40) along the radial plane (32) or line from the axis of rotation (0) at some point between the straight plane (28) and the inner face (27) is here defined as at least 10%, 20%, 30% and 40% of the distance (42) along the same radial line (41) between the top edge (30) of the inner face (27) and the outside face (42) of the sliding member (26)—depending on particular circumstances, in particular size of the particle material, where the inner space distance (40) is preferred to increase with smaller sized particle material.

Figure 5:
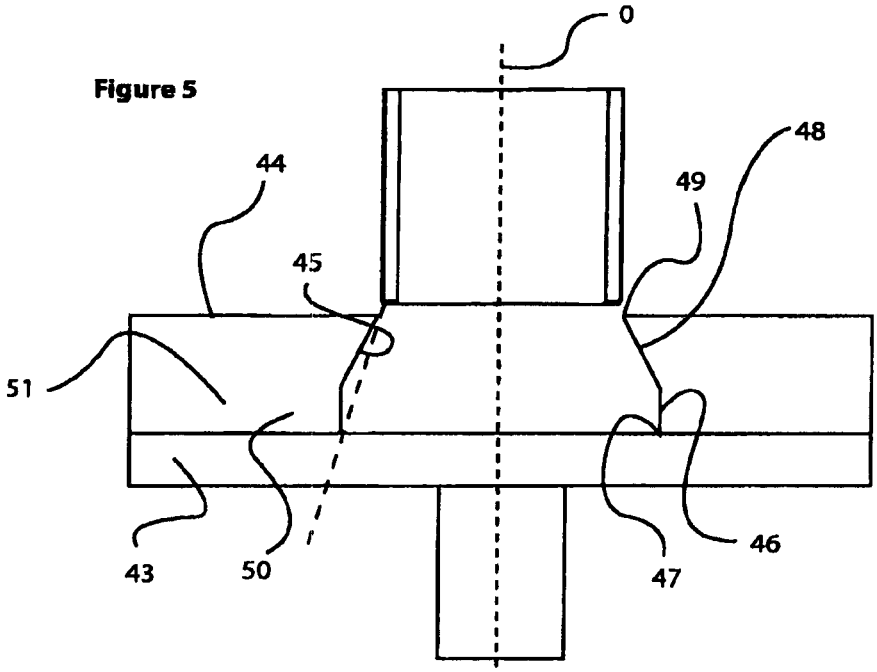
FIG. 5 shows, diagrammatically, a side view from a rotor according the invention provided with a second embodiment of the sliding member according the invention.
Figure 6:
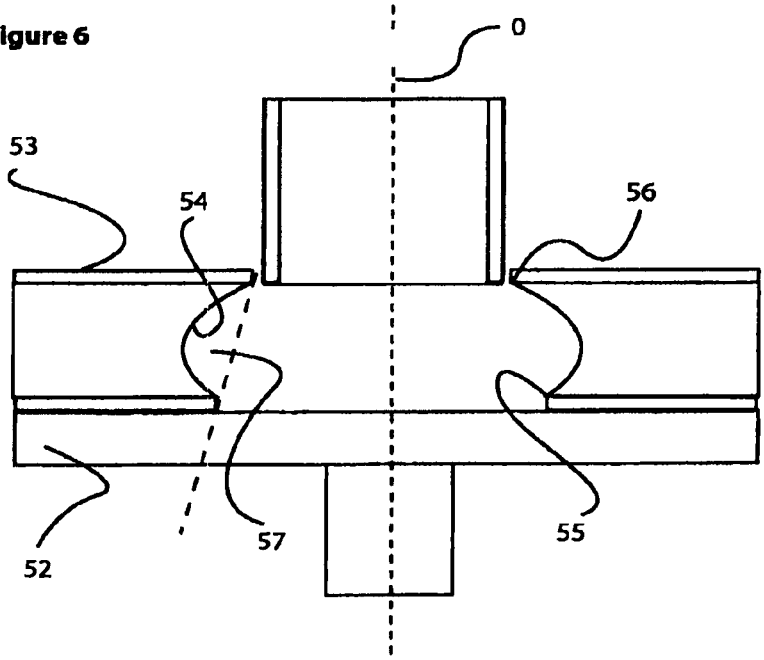
FIG. 6 shows, diagrammatically, a side view from a rotor according the invention provided with a third embodiment of the sliding member according the invention.

FIG. 5 shows, diagrammatically, a side view from a rotor (43) according the invention provided with a second embodiment of the sliding member (44) according the invention where the inner side (45) of the sliding member (44) is in vertical position (46) at the bottom edge (47) to become straight and angled (48) towards the top edge (49), which configuration tends to concentrate more particle material at the lower part (50) of the sliding face (51). FIG. 6 shows, diagrammatically, a side view from a rotor (52) according the invention provided with a third embodiment of the sliding member (53) according the invention where the inner face (54) is shaped as a concave with the bottom edge (55) positioned at greater radial distance from the axis of rotation (0) than the top edge (56), which configuration provides a more closed inner space (57).

Figure 7:
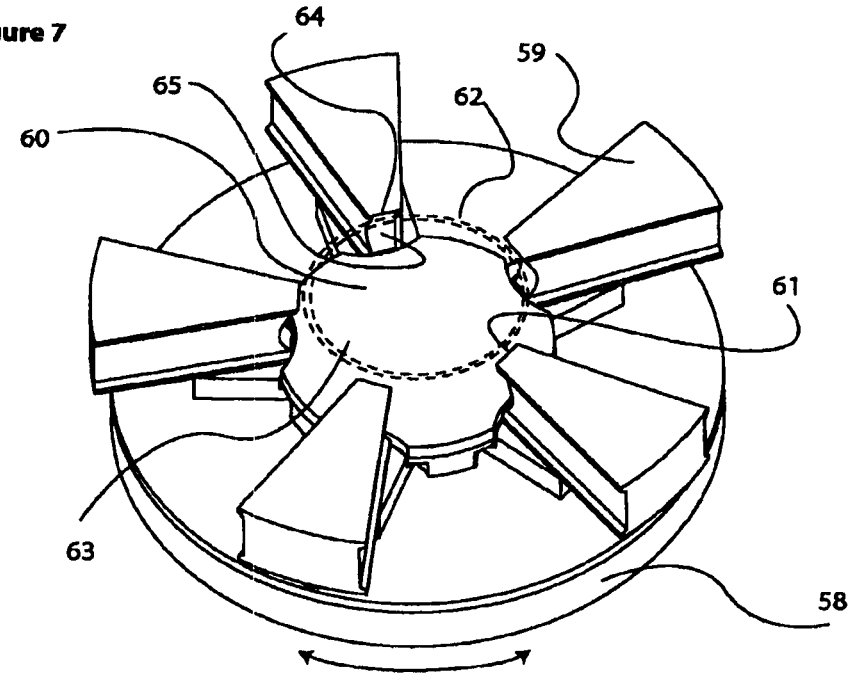
FIG. 7 shows, diagrammatically, a 3D view from a rotor according the invention essentially provided with the third embodiment of the sliding member according the invention from FIG. 6.

FIG. 7 shows, diagrammatically, a 3D view from a rotor (58) according the invention essentially provided with the third embodiment of the sliding member (59) according the invention from FIG. 6. A more closed centre space (60) makes the rotor (58) less sensitive to vortex pulling when there is a certain gap distance (61) between the between the outer edge (62) of the metering opening (63)—here indicated with a dashed line—and the top edge (64) of the inner face (65), for example because of wear. A closed inner space (66) also allows the top edge (64) to be positioned at some distance from the outer edge (66) of the metering opening (63); that is, that the inner face (65) is positioned at a greater radial distance from the axis of rotation (0) than the outer edge (62) of the metering opening (63) such that there is a larger gap distance (61) between the outer edge (62) of the metering opening (63) and the top edge (64) of the inner face (65). This has the advantage that sliding members (59) can become shorter.

Figure 8:
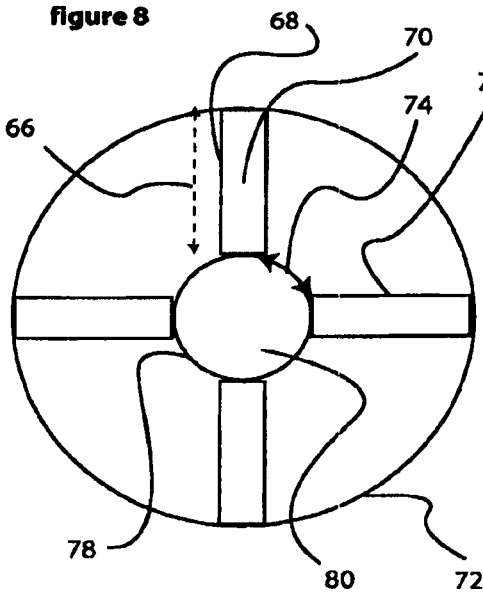
FIG. 8 shows, diagrammatically, a rotor with four sliding members.
Figure 9:
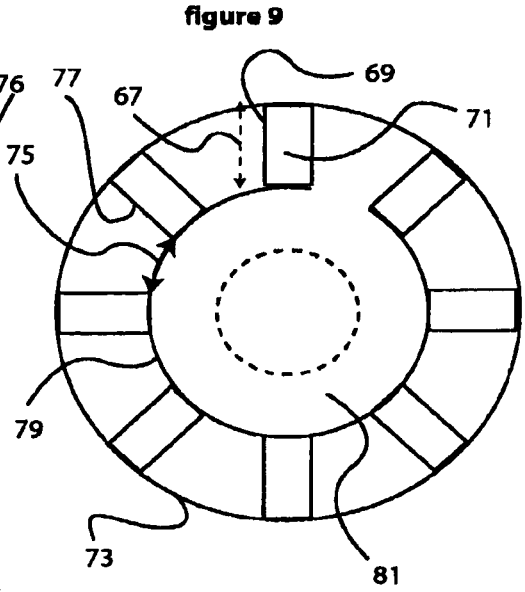
FIG. 9 shows, diagrammatically, a rotor with eight sliding members.

FIGS. 8 and 9 show, diagrammatically, that a reduction of the length (66)(67) of the sliding face (69) by some 50% means that the double amount of sliding members (70)(71) can be positioned on the rotor (72)(73)—here from four (70) to eight (71)—with essentially the same amount of wear material; although material required for attachment have to be taken into account the sliding members (71) are now significantly lighter. The shortest distance (74)(75) between the inner faces (76)(77) of the sliding members (70)(71) that are positioned around the outer edge (78)(79) of the centre space (80)(81) remains about similar, which means that transport of the particle material between and along the shorter sliding members (71) is not hindered. It is of course also possible to position less sliding members by making them thicker—which means that an optimum has to be found at specific practical conditions. With the shorter sliding faces (69) the particle material is now collected by the sliding members (71) at larger radial distance or collecting radius, which means that the inner face (77) where the particles are collected is moving at significant greater velocity and less sliding face length (67) is left for acceleration of the particles.

FIG. 10 show, diagrammatically, how the sliding member (82) affects the movement of the particles. The particles are metered into the centre space (83) of the rotor (84) and move then outwards along a spiral (85) to change direction (86) when they are collected by the sliding member (82) and are instantly accelerated in that the particles take the velocity of the sliding member (82) to be further accelerated along the sliding face (69) under influence of centrifugal force. During acceleration the particle develops a radial (Vr) and a transversal (Vt) velocity component and is thrown out at take-off angle (a) and at a take-off velocity (V) that is determined by the vector of these velocity components. With a radial directed sliding face (69) the angle of change of direction is typically 70°-80°.

FIG. (table) 11 show the influence of the length (l) of the sliding face (69) from FIG. 10 when the start radius (r1) is increased while the end radius (r2) and the rotational velocity (rpm) are kept constant at 800 rpm. From FIG. (table) 11 it appears that at 800 rpm a start radius (r1) of 150 mm and an end radius (r2) of 600 mm (length sliding face 450 mm) a take off velocity is obtained of ~70 m/s and a take-off angle of 43 degrees. At 375 mm start radius (length sliding face 225 mm) take off velocity is ~64 m/s and the take off angle 37 degrees. To obtain again 70 m/s rotational velocity has to be increased to ~865 rpm (not shown in FIG. 11). Also the take off angle can be corrected by directing the last part of the sliding face (69) in a somewhat backward direction.

It has however to be recognized that the gap distance (not shown here) between the metering member and the sliding member means that the vortex pull becomes stronger. At the same time the change in velocity during collection is increased from ~13 m/s to ~32 m/s (FIG. (table) 11) which means that the particles have to be collected in a way that they are not thrown out of the system through combination of vortex pull and rebound during collection because of impact and change of direction.

Sliding members (26) with a closed inner face (27) (see FIG. 4) are effective at greater radial distance, but less so than when a larger gap distance (7) is created. This problem can be solved with a cover member according the invention.

FIGS. 12 and 13 shows, diagrammatically, a housing (89) that is provided with a first embodiment of the cover member (88) according the invention, here an essentially circular cover member (88), that is positioned stationary essentially central above the rotor (90) and is carried by at least one stationary part (163) of the housing (89), which includes the metering member, the lid, and the housing, such that the centre point (91) of the cover member (88) coincides essentially with the axis of rotation (0) and has a radius at least equal or greater than the radial distance from the axis of rotation (0) to the inner face (92) of the sliding member (93) and is in the middle provided with an essentially circular central opening (94) of which the centre point (91) essentially coincides with the axis of rotation (0) and has a radius at least equal or greater than radial distance from the axis of rotation (0) to the outer edge (96) of the metering opening (97).

The gap distance (98) along the radial line (100) from the axis of rotation (0) between the top edge (99) of the inner face (92) and the outer edge (96) of the metering opening (97) can be taken to be at least at least 20%, 30%, 40% or 50%—or even more—of the distance (102) along the same radial line (100) between the outer edge (96) of the metering opening (97) and the outer face (101) of the sliding member (93), depending on the characteristics of the feed material.

FIGS. 14, 15 and 16 show, diagrammatically, three further basic embodiments of the cover member (103)(104)(105) for an open rotor (106), diagrammatically, where FIG. 14 shows, diagrammatically, a second basic embodiment where the cover member (103) has a flat face (108) and FIG. 15 shows a third basic embodiment where the cover member (103) is a combination of truncated cone (109) surrounded by a flat face (110). FIG. 16 shows, diagrammatically, a fourth basic embodiment of a cover member (105) according the invention that has an essentially circular cylindrical shape (111) where the topside can open as shown here or completely or partly closed (not shown here).

FIG. 17 shows, diagrammatically, a fifth basic embodiment of the cover member (112) according the invention where there is a free circulation opening (113) between the metering member (114) and the cover member (112) such that air can re-circulate (125) from the housing (not shown here) into the space (115) underneath the cover member (112) that can limit release of dust through the outlet of the crusher (not shown here).

FIG. 18 shows, diagrammatically, a rotor (116) with a sixth embodiment of the cover member (117) according the invention, essentially similar to the first basic embodiment (102) from FIG. 12, where the metering member (118) hangs freely in the truncated cone (119) which is provided with radial partitions (120) to hinder formation of vortices within the cone (119) and these partitions (120) are here connected with the metering member (118) that carries the cover member (117). The cover member (117) is here along the outer edge (121) protected with a wear part ring (122) that can be replaced.

FIG. 19 shows, diagrammatically, a seventh basic embodiment of the cover member (123); essentially a rotor (124) with the cover member (123) essentially according the second basic embodiment (103) from FIG. 15, where the down face (126) of the cover member (123) that is directed towards the rotor (124) has a flat surface. The cover member (123) is here carried by the lid (127) of the housing (128), with the aid of a wide hollow circular cylinder (129) that has an inner diameter about equal to the diameter of the cover member (123) that avoids build of material on top of the cover member (123). Another smaller hollow cylinder (130) is positioned in the centre of the wide cylinder (129) in which the metering member (131) is positioned. The cover member (123) is provided with a wear ring (132) around the outer edge that can be exchanged in case of wear.

FIGS. 20 and 21 show, diagrammatically, an embodiment of the crusher (133) according the invention provided with a conical cover member (134). The embodiment (134) contains a housing (135) that is here provided with a rotor chamber (136) that is here covered by a two-piece lid member (137) (138) with a centre lid (137) and an outer lid (138), the rotor chamber (136) is provided with a rotor (139) which is carried by a shaft (140) that rotates about an essentially vertical axis of rotation (0) here in at least one direction and a metering member (141) that is here carried by the centre lid (137) and is provided with an essentially circular metering opening (159), the outer edge (160) of which metering opening (159) is positioned at a location essentially central above the rotor (139) such that the centre point (153) of the metering opening (159) coincides essentially with the axis of rotation (0), for metering the material into the centre space (142) of the rotor (159).

The rotor (139) carries the relative short sliding members (143), which are here positioned along the outer border (144) of the rotor (139) a distance away from the outer edge (160) of the metering opening (159) and allows here for eight sliding members (143), providing a very long continuous operation time. The sliding member (143) that is provided with a sliding face (145) that stretches into the direction of the outer boarder (144) of the rotor (139) between an inner face (146) that is directed towards the axis of rotation (0), at which inner face (146) the metered material is collected for accelerating along the sliding face (145) by centrifugal force and an outside face (147) that is directed towards the surrounding housing (135) from where the accelerated material is thrown from the sliding face (145), which inner face (146) stretches in vertical direction between a bottom edge (148) and a top edge (149). The inner face (146) is positioned essentially behind the straight plane (150) with on it the bottom edge (148) and the top edge (149), such that a closed inner space (151)—actually a half closed inner space—is created between the straight plane (150) and the inner face (146). The material is metered through the metering opening (159) into the centre space (142) of the rotor (139) and than collected by the sliding members (143) to be accelerated under influence of centrifugal force to be thrown from the rotor (139), here for impact against the stationary impact member (152) that is positioned around the rotor (139).

The housing (135) is here provided with an essentially circular downwards widening truncated essentially conical cover member (134) according the invention—that is positioned stationary essentially central above the rotor (139) and is carried by the outer lid (138) such that the centre point (153) of the cover member (134) coincides essentially with the axis of rotation (0) and has a radius at least equal or greater—here equal—than the radial distance from the axis of rotation (0) to the inner face (146) of the sliding member (143) and is in the middle provided with an essentially circular central opening (154) of which the centre point essentially coincides with the axis of rotation (0) and has a radius at least equal or greater—here greater—than radial distance from the axis of rotation (0) to the outer edge (160) of the metering opening (159).

Together, the concave closed inner face (146) and the cover member (134) hinder the material from escaping because of vortex pulling through the gap distance (155) between the outer edge of the conical cover member (134) and the fast rotating inner face (146) of the sliding members (143).

The metering member (141) hangs here freely in the central opening (154) of the conical cover (134) with the metering opening (159) positioned here at a level below the central opening (154). This provides a free circulation opening (156) between the metering member (141) and the cover member (134) such that air can re-circulate (157) from the housing (135) into the space underneath the cover member (134) where pressure in the centre space (142) is lower, limiting dust. The cover member (134) is here provided with radial partition walls (161) that hinder the formation of vortices within the cone (162).

It is clear that the rotor can be implemented with any other embodiment mentioned here in the invention—and embodiments derived there from. The rotor can for example be provided with accelerating units that each consist out of a sliding member and an associated impact member for acceleration by impact. The sliding member can also be provided with an autogenous sliding face and also the co-rotating impact member can be provided with a metal but also with an autogenous impact face, and even a combination of both. The housing can be provided with one lid but also a two part lid as described in and can also be constructed without a lid, that is for example with a side port for exchange of wear parts.

The above descriptions of specific embodiments of the present invention have been given with a view to illustrative and descriptive purposes. They are not intended to be an exhaustive list or to restrict the invention to the precise forms given, and having due regard for the above explanation, many modifications and variations are, of course, possible. The embodiments have been selected and described in order to describe the principles of the invention and the practical application possibilities thereof in the best possible way in order thus to enable others skilled in the art to make use in an optimum manner of the invention and the diverse embodiments with the various modifications suitable for the specific intended use. The intention is that the scope of the invention is defined by the appended claims according to reading and interpretation in accordance with generally accepted legal principles, such as the principle of equivalents and the revision of components.

The invention claimed is:

1. Device for accelerating particle material with a rotor comprising:

a housing (135) that is provided with a lid member (137) (138), at least a shaft (140) that carries a rotor (139) (25) of open type, such that the rotor (139)(25) is rotatable about an essentially vertically directed axis of rotation (0) in at least one direction and a metering member (141) that is provided with an essentially circular metering opening (163), the outer edge (164) of which metering opening (163) is positioned at a location essentially central above the rotor (139) such that the centre point (165) of the metering opening (163) coincides essentially with the axis of rotation (0), for metering the material on the centre space (1420) of the rotor (139)(25), at least one acceleration unit that is carried by the rotor (139)(25) at a position a distance away from the axis of rotation (0) and consists out of at least one sliding member (143)(26) that is provided with a sliding face (145 (39)) that stretches into the direction of the outer boarder (144) of the rotor (139)(25) between an inner face (146) (27) that is directed towards the axis of rotation (0) where the metered material is collected for accelerating along the sliding face (145)(39) by centrifugal force and an outside face (147)(42) that is directed towards the surrounding housing (135) from where the accelerated material is thrown from the sliding face (145)(39), which inner face (146)(27) stretches in vertical direction between a bottom edge (148)(29) and a top edge (149) (30), characterized in that:

the inner face (27) is positioned essentially behind the straight plane (28) or line with on it the bottom edge (29) and the top edge (30), such that part of the inner face (27) is positioned at a greater radial distance from the axis of rotation (0) than the straight plane (28) and a closed inner space (31) is created between the straight plane (28) and the inner face (27).

2. Device for accelerating particle material with a rotor according claim 1, where the bottom edge is positioned at a radial distance from the axis of rotation equal to or greater than the top edge.

3. Device for accelerating particle material with a rotor according claim 1, where the minimum inner space distance along the radial line from the axis of rotation at some point between the straight plane and the inner face is at least 10% of the distance along the same radial line between the top edge o the inner face and the outside face.

4. Device for accelerating particle material with a rotor according claim 2, where the minimum inner space distance along the radial line from the axis of rotation at some point between the straight plane and the inner face is at least 20% of the distance along the same radial line between the top edge of the inner face and the outside face.

5. Device for accelerating particle material with a rotor according claim 2, where the minimum inner space distance along the radial line from the axis of rotation at some point between the straight plane and the inner face is at least 30% of the distance along the same radial line between the top edge of the inner face and the outside face.

6. Device for accelerating particle material with a rotor according claim 1, where the inner face is positioned at a greater radial distance from the axis of rotation than the outer edge of the metering opening such that there is a gap distance between the outer edge of the metering opening and the top edge of the inner face.

7. Device for accelerating particle material with a rotor according claim 6, where the housing is provided with an essentially circular cover member that is positioned stationary essentially central above the rotor and is carried by at least one stationary part of the housing such that the centre point of the cover member coincides essentially with the axis of rotation and has a radius at least equal or greater than the radial distance from the axis of rotation to the inner side of the sliding member and is in the middle provided with an essentially circular central opening of which the centre point essentially coincides with the axis of rotation and has a radius at least equal or greater than radial distance from the axis of rotation to the outer edge of the metering opening.

8. Device for accelerating particle material with a rotor according claim 6, where the gap distance along the radial line from the axis of rotation between the top edge of inner face and the outer edge of the metering opening is at least 20% of the distance along the same radial line between the outer edge of the metering opening and the outer face of the sliding member.

9. Device for accelerating particle material with a rotor according claim 6, where the gap distance along the radial line from the axis of rotation between the top edge of inner face and the outer edge of the metering opening is at least 30% of the distance along the same radial line between the outer edge of the metering opening and the outer face of the sliding member.

10. Device for accelerating particle material with a rotor according claim 6, where the gap distance along the radial line from the axis of rotation between the top edge of inner face and the outer edge of the metering opening is at least 40% of the distance along the same radial line between the outer edge of the metering opening and the outer face of the sliding member.

11. Device for accelerating particle material with a rotor according claim 6, where the gap distance along the radial line from the axis of rotation between the top edge of inner face and the outer edge of the metering opening is at least 50% of the distance along the same radial line between the outer edge of the metering opening and the outer face of the sliding member.

12. Device for accelerating particle material with a rotor according claim 7, where there is a free circulation opening between the metering member and the cover member such that air can re-circulate from the housing into the space underneath the cover member.

13. Device for accelerating particle material with a rotor according claim 7, where at least part of the face of the cover member that is directed towards the rotor has an essentially flat surface that stretches along an essentially horizontal plane.

14. Device for accelerating particle material with a rotor according claim 7, where at least the central part of the face of the cover member that is directed towards the rotor has a downwards widening truncated conical shape.

15. Device for accelerating particle material with a rotor according claim 14, where the truncated conical part is provided with at least one radial partition member to hinder formation of vortices.

16. Device for accelerating particle material with a rotor according claim 7, where the cover member is provided with at least a part of the metering member.

17. Device for accelerating particle material with a rotor according claim 7, where the cover member is carried by the metering member.

18. Device for accelerating particle material with a rotor according claim 7, where at least part of the cover member has an essentially circular cylindrical shape.

19. Device for accelerating particle material with a rotor according claim 1, where the sliding member is symmetrical to a radial plane from the axis of rotation.

20. Device for accelerating particle material with a rotor according claim 1, where the sliding member is associated with an impact member that is carried by the rotor.

* * * * *